United States Patent [19]

Morhard

[11] 4,387,498

[45] Jun. 14, 1983

[54] METHOD FOR MAKING HELICALLY WOUND SURFACE-COATED TUBES, AND APPARATUS FOR CARRYING OUT THIS METHOD

[76] Inventor: Alfred Morhard, Königsberger Str. 24, 7272 Altensteig-Waldd., Fed. Rep. of Germany

[21] Appl. No.: 132,363

[22] Filed: Mar. 20, 1980

[30] Foreign Application Priority Data

Mar. 28, 1979 [DE] Fed. Rep. of Germany ..... 2912308

[51] Int. Cl.[3] ..... B22D 11/126

[52] U.S. Cl. ..... 29/527.2; 29/435; 29/157.3 AH; 29/455 LM; 29/456; 72/145; 156/162; 156/195

[58] Field of Search ..... 29/527.2, 435, 456, 29/455 LM, 149.5 R, 149.5 S, 149.5 C, 149.5 DP, 149.5 NM, 157.3 AH; 113/116 UT, 1 M; 72/145; 156/162, 195

[56] References Cited

U.S. PATENT DOCUMENTS

| | | | |
|---|---|---|---|
| 285,576 | 9/1983 | Coas . | |
| 1,999,151 | 4/1935 | Finley | 242/7.22 X |
| 2,998,339 | 8/1961 | Barnes et al. | 154/83 |
| 3,235,941 | 2/1966 | Krotz | 29/149.5 NM |
| 3,750,249 | 8/1973 | Brandon et al. | 29/149.5 NM |

FOREIGN PATENT DOCUMENTS

| | | | |
|---|---|---|---|
| 214988 | 11/1957 | Australia | 242/7.21 |
| 746300 | 7/1944 | Fed. Rep. of Germany . | |
| 2201485 | 8/1973 | Fed. Rep. of Germany . | |
| 2166791 | 2/1976 | Fed. Rep. of Germany . | |
| 1294966 | 4/1962 | France . | |
| 268229 | 8/1950 | Switzerland . | |
| 1367631 | 9/1974 | United Kingdom | 242/7.22 |

*Primary Examiner*—Lowell A. Larson
*Assistant Examiner*—V. K. Rising
*Attorney, Agent, or Firm*—Flynn, Thiel, Boutell & Tanis

[57] ABSTRACT

A method of making a multi-layer tube includes the steps of pre-heating two elongate metal strips and bending each to a substantially arcuate curvature. Each strip is then wound helically with abutting edges, one strip being closely concentrically wound around and axially offset with respect to the other, so that the strips define a cylindrical tube. A synthetic resin is applied between the strips and to the interior of the tube during the winding step and is then pre-cured. Thereafter, a coating of the synthetic resin is applied to the exterior of the tube and then all of the synthetic resin is fully cured.

4 Claims, 4 Drawing Figures

METHOD FOR MAKING HELICALLY WOUND SURFACE-COATED TUBES, AND APPARATUS FOR CARRYING OUT THIS METHOD

FIELD OF THE INVENTION

This invention relates to a method of making a tube for conveying fluids and, more particularly, to a method of making a metal tube having a plastic coating on the outer surfaces thereof.

There is generally a very great demand for tubes for conveying fluids. Such tubes have to meet high requirements as regards their impermeability for gasses and liquids, resistance to attack by chemicals, hygienic soundness for employ in the food industry, and weight. The conventionally employed cement-lined cast-iron pipes for instance are extremely heavy. In order to obtain chemical-resistant surfaces meeting the health requirements in the food industry, metal tubes are usually provided with a plastic coating on their outer surfaces.

In a tube-making method as described in DE-PS No. 746,300, steel sheet strips are wound on a tubular mandrel, with the interposition between adjacent strip layers of a material for welding or soldering said metal strip layers to one another so as to obtain an impermeable tube wall. A lubricant in the form of silicon oil is usually employed for facilitating removal of the finished tube from the mandrel on which it is wound. Suitable materials for subsequently coating the surfaces of such tubes in order to obtain the above mentioned properties of impermeability, chemical resistance and hygienic soundness include in particular synthetic resins. Such resins will only adhere, however, to absolutely clean surfaces. It is therefore indispensable to thoroughly clean the contaminated surfaces of tubes made in the above described manner prior to coating them. This cleaning step can only be carried out after completely finishing the winding step and therefore involves an expensive and time-consuming sand-blasting method.

Even the employ of one of the methods described in DE-OS No. 21 66 791 involves the use of lubricants to reduce the friction of the tube formed in an outer mould during removal therefrom.

It is an object of the present invention to provide a method for making multiple-layer tubes consisting of at least two wound metal strips, wherein the metal strips of each layer are helically wound in abutting relationship of their side edges, and each further metal strip layer is axially offset with respect to the preceding one, an intermediate material layer being introduced between adjacent metal strip layers during the winding step, and to improve a method of this type in such a manner that it permits a synthetic resin to be employed for the intermediate material layer between individual metal strip layers as well as for a surface coating material.

SUMMARY OF THE INVENTION

In order to solve this problem, the invention provides that said metal strips are pre-shaped by bending them to a substantially circular-arcuate configuration while in heated state, that a continuous synthetic resin layer is formed during the winding step between the inner and the outer metal strip layer, a further synthetic resin layer being applied to the interior wall surface of the tube during the formation thereof, said synthetic resin layers being subjected to a first curing step during their formation, that the outer surface of the tube is thereafter provided with a synthetic resin layer, and that said synthetic resin layers are subsequently subjected to a final curing step.

The method outlined above offers the advantage that lightweight, impermeable and surface-coated tubes of helically wound metal strips can be produced in a single continuous operation. Prior to being wound, the metal strips can be sand-blasted in a very simple, continuous manner, so that the expensive and time-consuming step of sand-blasting the finished tubes is avoided, resulting in a drastic reduction of production costs and a considerably increased output.

In the method according to the invention, heated metal strips are pre-shaped by means of bending rollers, and are then wound in laterally abutting relationship with individual layers being offset relative to one another. After pre-shaping by means of the bending rollers, the bending radius of the metal strips preferably corresponds to the radius of the circular tube wall. A continuous synthetic resin layer is sprayed between the inner and the outer metal strip layer already during the winding step. Immediately after formation of the inner wall surface of the tube, a further synthetic resin layer is applied thereto. As the metal strip layers are to be bonded to one another by the intermediate synthetic resin layer, and as the molecular cross linkage required to this effect is an endothermic process, heat is already supplied at this point of the method for a first curing of the synthetic resin. Only thereafter the outer surface of the tube is also spray-coated with a synthetic resin, whereupon the now completely surface-coated tube is subjected to a treatment to finish the curing of all synthetic resin layers.

The metal strips are preferably wound into a cyindrical outer mould mounted for rotation as well as for axial movement. This results in no relative movement occurring between the outer mould and the metal strips being wound thereinto. In the contrary, the rotation and simultaneous axial movement of the outer mould result in the metal strip windings advancing within the mould as they are being formed. Since the tube does thus not have to be moved relative to the mould, lubricants such as silicon oil are not required, thus avoiding any contamination of the tube's surface and the necessity for cleaning the tube.

A particularly suitable coating material is a synthetic resin powder, preferably a thermosetting composition.

The invention also relates to apparatus for carrying out the method, comprising a cylindrical outer mould mounted for rotation about its own axis. In order to permit a continuous winding of multiple-layer metal strip tubes without any relative movement between the tube and the mould, amd thus without the employ of lubricants, the mould is preferably formed of a plurality of segments carried by circulating endless belts. As the outer mould simultaneously rotates about its own axis, the metal strips can be wound into the mold without being moved relative thereto. Due to the circulation of the endless belts, the tube is thus advanced through the mould and released therefrom at the downstream end. Since the employ of an outer mould of this construction does not require the use of any lubricants, the intermediate and surface layers of synthetic resin can be formed simultaneously with the winding step.

In order to preclude even the slightest relative movement during winding and during the first curing of the synthetic resin, the segments of the outer mould are preferably formed by permanent magnets.

The spray apparatus for forming the intermediate synthetic resin layer between the metal strip layers is preferably located immediately adjacent the upstream opening of the outer mould, together with the spray apparatus employed for coating the interior wall surface of the wound tube. Since the coating of the outer surface of the tube is carried out immediately after leaving the outer mould, the respective spraying apparatus is preferably located immediately adjacent the outlet of the mould. After a certain cross-linking and setting period, the offset helical metal strip windings are securely and impermeably bonded to one another. The tubes made by the explained method and with the employ of the described apparatus show not only the already mentioned advantages, but also have absolutely identical outer diameter. This is of particular importance for obtaining a perfect seal during installation of the tubes.

Prior to coating the outer surface of the tubes, the end portiones thereof are preferably formed with at least one bayonet slot opening each by means of a milling tool located immediately downstream of the outer mould, such bayonet openings serving to interconnect the abutting ends of adjacent tubes during installation. After formation of the openings, the outer surface of the tube is sprayed with the spray apparatus disposed downstream of the milling tool, so that the inside edges of the cut openings are also coated. The described apparatus and its arrangement thus permit to carry out a continuous method for making tubes by helically winding at least two metal strip layers in offset relationship to one another, bonding said metal strip layers by the use of synthetic resin, providing the tubes with bayonet openings and coating their surfaces in a single high-speed operation sequence.

BRIEF DESCRIPTION OF THE DRAWINGS

Embodiments of the invention shall now be described in detail with reference to the accompanying drawings, in which.

DETAILED DESCRIPTION

Figure 1:
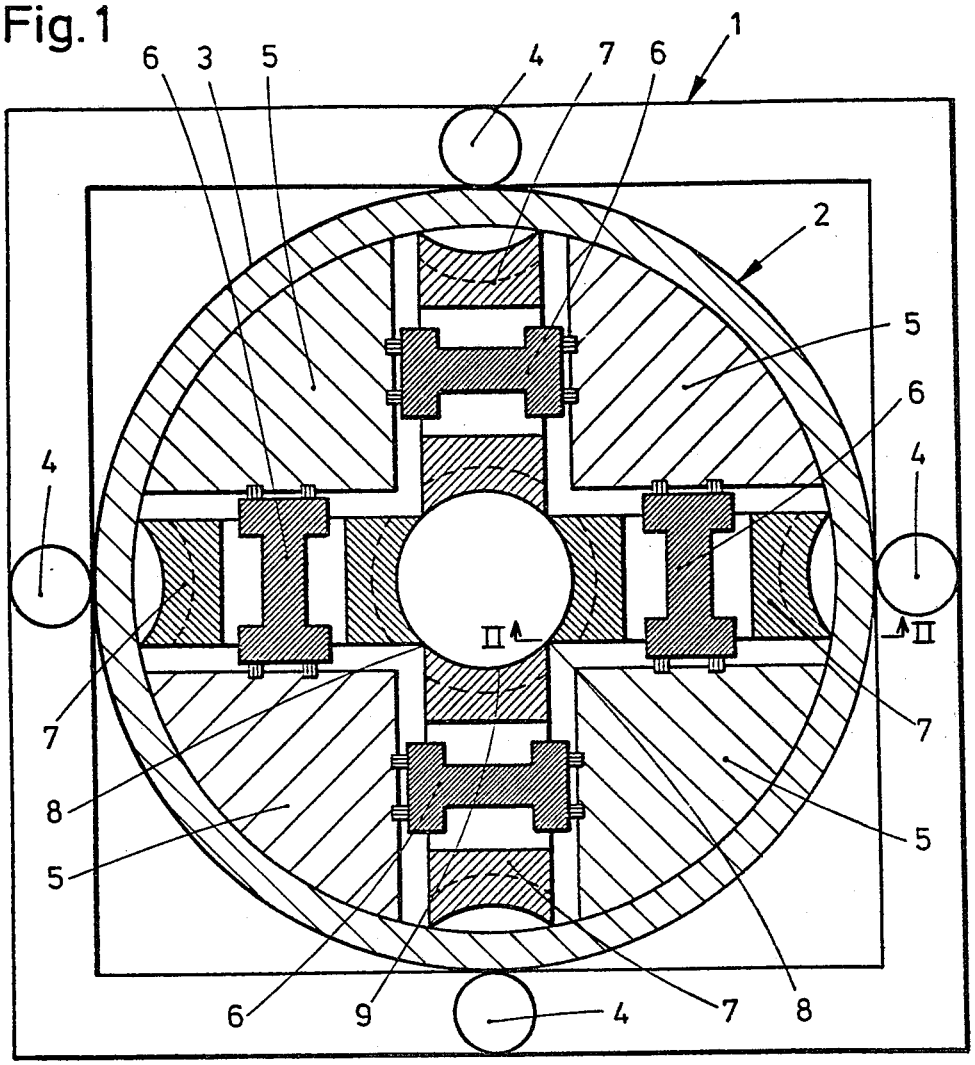
FIG. 1 shows a diagrammatical cross-sectional view of an outer mould according to the invention.

FIG. 1 shows a rectangular frame 1 surrounding a cylindrical outer mould 2 and carrying rollers 4 at the contact points between the outer wall surface 3 of mould 2 and frame 1. Cylindrical outer mould 2 comprises four sectors 5 of identical size interconnected at equal distances by means of connector inserts 6. The spaces between sectors 5 are occupied by four endless belt assemblies 7 arranged in such a manner that the edges 8 of each belt assembly 7 are in contact with adjacent edges of two adjacent belt assemblies. In this manner the concave end surfaces 9 of the belt assemblies 7 facing towards the center of the mould define a cylindrical hollow mould.

Figure 2:
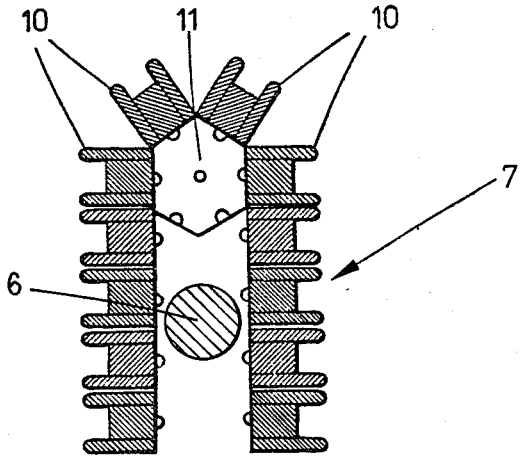
FIG. 2 is a fragmentary sectional view taken along line II—II of FIG. 1 with the outer sectional portion of outer mold 2 omitted and shows a portion of an endless segment carrier belt.

FIG. 2 shows a portion of an endless belt assembly 7, comprising a plurality of individual members 10 in the form of permanent magnets. Each endless belt assembly 7 is guided over a return roller 11.

Rollers 4 in frame 1 are simultaneously and unidirectionally rotated to cause mould assembly 2 to rotate about its own axis within frame 1. At the same time the four endless belt assemblies are set in circulating movement, so that the cylindrical inner wall surface formed by the four belt assemblies 7 is uniformly advanced in axial direction.

During this rotary and axial movement of the outer mold 2, heated and in accordance with the inside radius of the mould cavity pre-bent metal strips are introduced into the mould opening. At least two such metal strips are helically wound into the mould with abutting side edges and in mutually offset relationship, said helical winding as well as the advance of the wound tubes through the mould being caused by the rotation of the mould and the circulation of the endless belt assemblies. There does thus not occur any relative movement between the tube being wound and the outer mould, so that any displacement or shifting of the metal strips relative to one another during the winding operation is precluded, as the metal strips are additionally retained by the permanent magnets 10 forming the members of the endless belt assemblies.

On being wound into the outer mould, the two mutually offset metal strips define a wedge-shaped cavity, into which a coating powder is sprayed in an excess amount. On further winding into the mould, the metal strips are brought into close contact, the excess coating powder therebetween preventing the formation of bubbles in the intermediate layer. The excess coating material leaks through the butt seams of the formed tube, resulting in the formation of a helical bead on the interior wall surface. This bead is removed by mechanical means, whereupon the interior wall surface is immediately sprayed with the synthetic resin powder.

The intermediate layer, which is intended to bond the two metal strip layers to one another, as well as the coating of the interior wall surface of the produced tube are immediately subjected to a pre-curing of the synthetic resin by the supply of heat during the winding operation.

After having been wound, bonded, and coated with synthetic resin on its interior wall surface, the tube is caused to leave the downstream end of the mould by the combined rotation and axial movement thereof. The outer surface of the otherwise finished tube may then be coated with synthetic resin by means of a spray apparatus located immediately adjacent the downstream end of the mould.

In a particularly advantageous embodiment, however, a milling tool is located upstream of said spray apparatus. This tool is used for shaping the ends of the finished tubes in the manner shown in FIG. 3.

Figure 3:
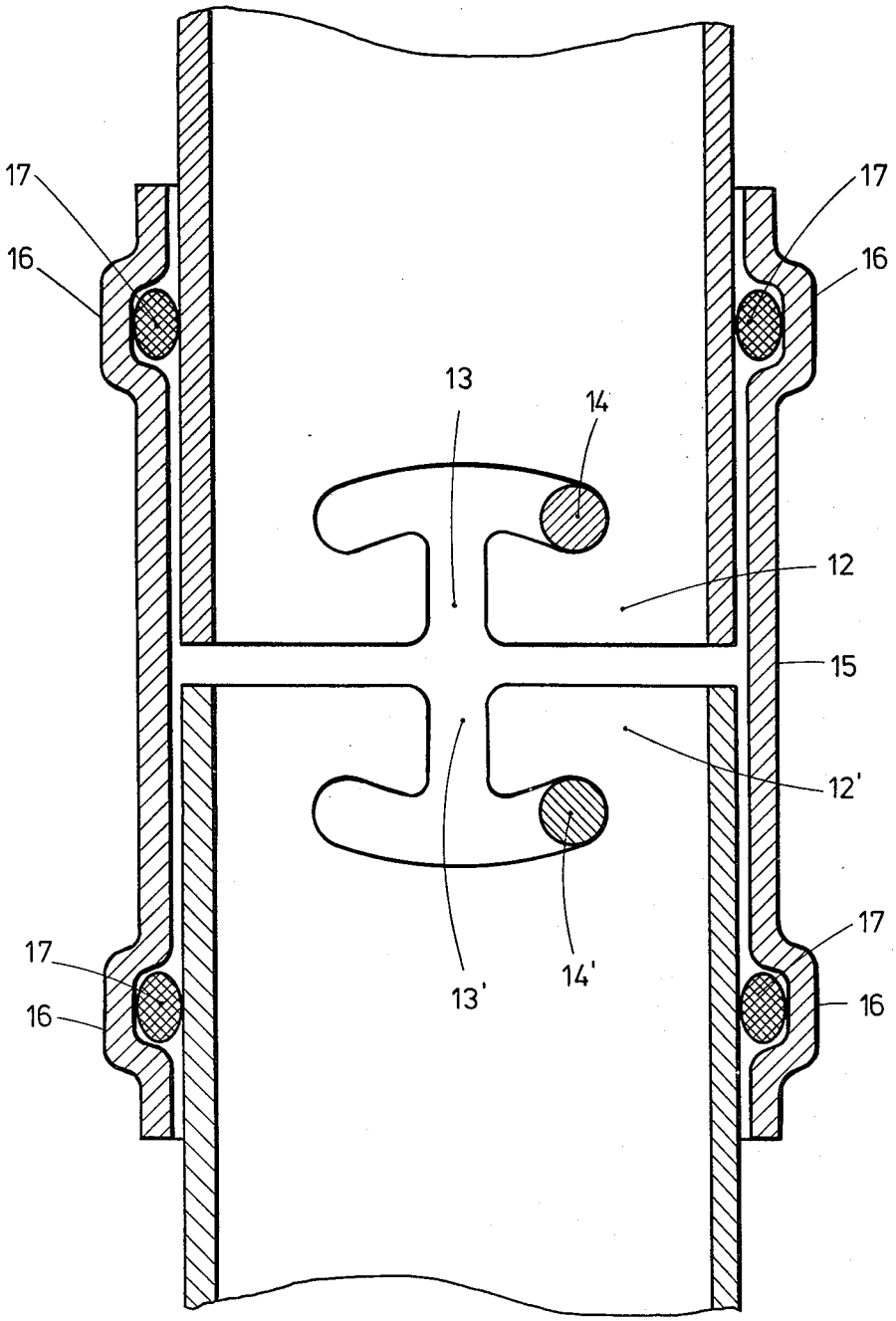
FIG. 3 shows a sectional view of the end portions of two adjacent tubes provided with bayonet openings and interconnected by means of a connector sleeve.

This figure shows two abutting tube ends 12, 12' formed with milled openings 13, 13' at opposite positions. Openings 13, 13' may be substantially T-shaped as shown in FIG. 3. Openings 13, 13' are engaged by pins 14, 14' projecting from the interior wall surface of a connector sleeve 15 surrounding the two tube ends. Adjacent both of its end, sleeve 15 is formed with annular grooves 16 each containing an annular seal 17.

During installation of the tubes, the pins 14 projecting from the interior wall surface of connector sleeve 15 are inserted into a pair of facing openings 13, 13', whereupon sleeve 15 is turned to engage pins 14 in the manner of a bayonet coupling. By this novel and inventive method for connecting the tube ends during installation of the tubes it is ensured that the advantageous properties of the tubes made with the apparatus according to the invention, namely, chemical resistance and impermeability, are not sacrificed at the tube connections. These properties are particularly ensured by the fact that the coating of the outer surface of the finished tubes takes place only after the bayonet openings have been formed, so that their cut edges are also coated. The connector sleeve may likewise be surface-coated in a separate operation.

Figure 4:
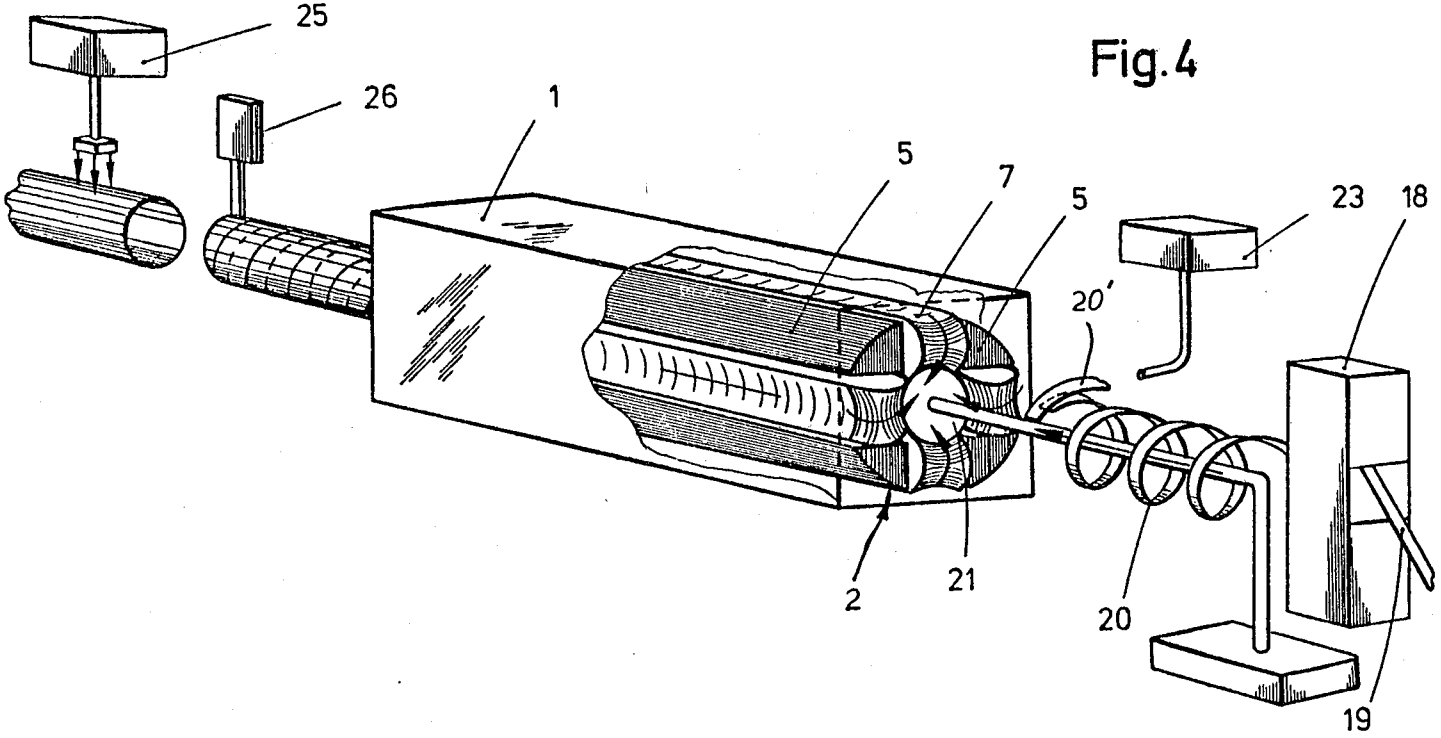
FIG. 4 is a fragmentary perspective view of an apparatus according to the invention.

FIG. 4 illustrates part of the apparatus described hereinabove, including the frame 1 and the rotatable outer mould 2 therein which includes the four sectors 5 and the four endless belt assemblies 7. Reference numeral 18 designates the bending device which preshapes the metal strip 19 so that it has an arcuate curvature, as shown at 20. Reference numeral 23 designates the device which is located adjacent the upstream opening of the outer mould 2 and sprays the synthetic resin powder between the two curved metal strips 20 and 20' as they are wound together. Reference numeral 21 designates the device which is located adjacent the upstream opening of the outer mould 2 and sprays the synthetic resin powder onto the interior of the metal tube. Reference numeral 26 designates the milling tool which is located downstream of the outer mould 2 and creates the T-shaped openings 13 and 13' (FIG. 3) in the tube. Reference numeral 25 designates the spray apparatus which is located downstream of the milling tool and sprays the synthetic resin onto the exterior of the metal tube.

After the winding of the metal strip layers in abutting relationship, the bonding thereof by means of a synthetic resin, the coating of the interior wall surface with a synthetic resin, the cutting of the openings for the bayonet coupling in the tube ends, and the subsequent coating of the outer surface of the otherwise finished tube, the tube is conveyed to a downstream station in which final curing of all synthetic resin layers takes place.

The embodiments of the invention in which an exclusive property or privilege is claimed are defined as follows:

1. A method of making a multi-layer tube, comprising the steps of preheating two elongate, flat metal strips; bending each said preheated metal strip to a substantially arcuate curvature; winding each said curved metal strip in a helical configuration with the edges of adjacent windings butting against each other, one said strip being closely concentrically wound around and axially offset with respect to the other said strip, whereby said metal strips define a generally cylindrical metal tube; applying a first synthetic resin between said metal strips as said strips are wound into said concentric relationship, thereby effecting a continuous and concentric layer of resin intermediate said strips; applying a continuous coating of second synthetic resin to the radially inner surface of said tube during said winding step; pre-curing said intermediate layer and said inner coating thereafter applying a continuous coating of a third synthetic resin to the radially outer surface of said tube; and curing fully said intermediate layer, inner coating and outer coating.

2. A method according to claim 1, including, after said step of pre-curing said intermediate layer and inner coating and before said step of applying said outer coating, the steps of cutting said tube into sections and milling at least one opening near each end of each said tube section.

3. A method according to claim 1, wherein during said winding step said metal strips are supported by a cylindrical outer mould which is supported for rotation and for advancement in an axial direction.

4. A method according to claim 1 or claim 3, wherein said synthetic resin are thermo-setting resins.

* * * * *